US005137174A

United States Patent [19]

Bell

[11] Patent Number: 5,137,174

[45] Date of Patent: Aug. 11, 1992

[54] PIVOTING PAPER TRAY

[75] Inventor: Conrad J. Bell, Webster, N.Y.

[73] Assignee: Xerox Corporation, Stamford, Conn.

[21] Appl. No.: 647,854

[22] Filed: Jan. 30, 1991

[51] Int. Cl.[5] ..... B65H 1/00

[52] U.S. Cl. ..... 271/161; 271/164

[58] Field of Search ..... 271/145, 161, 164, 171, 271/9

[56] References Cited

U.S. PATENT DOCUMENTS

| | | | |
|---|---|---|---|
| 946,724 | 1/1910 | Dixon | 271/161 |
| 974,556 | 11/1910 | Dixon | 271/161 |
| 1,850,108 | 3/1932 | Hunter et al. | 271/161 |
| 2,227,643 | 1/1941 | Hageman | 271/161 |
| 3,008,606 | 11/1961 | Limberger | 271/9 |
| 3,511,496 | 5/1970 | Zoglmann | 271/161 |
| 3,720,407 | 3/1973 | Woodward | 271/161 |
| 4,415,263 | 11/1983 | Hoffman | 271/161 |
| 4,525,063 | 6/1985 | Eisbein | 271/145 |
| 4,623,137 | 11/1986 | Irie et al. | 271/164 |
| 4,714,243 | 12/1987 | Staniszewki | 271/171 |
| 4,915,372 | 4/1990 | Kano et al. | 271/164 |

FOREIGN PATENT DOCUMENTS

| | | | |
|---|---|---|---|
| 165126 | 12/1985 | European Pat. Off. | 271/171 |
| 254430 | 11/1986 | Japan | 271/161 |
| 1160164 | 7/1969 | United Kingdom | 271/9 |

OTHER PUBLICATIONS

Schwarz, G. "Paper Tray Heater", *Xerox Disclosure Journal*, vol. 1, No. 4, pp. 41–42 (Apr. 1976).

*Primary Examiner*—Robert P. Olszewski
*Assistant Examiner*—Steven M. Reiss
*Attorney, Agent, or Firm*—William A. Henry, II

[57] ABSTRACT

In order to minimize the footprint of a copier, a two-part paper tray is used with one part of the paper tray being pivotably attached to another part of the paper tray for pivoting upward along the back of the copier during use. The pivoting of the paper tray also serves to minimize multi-feeding by fanning the copy sheets.

10 Claims, 3 Drawing Sheets

PIVOTING PAPER TRAY

Cross reference is hereby made to copending and commonly assigned U.S. application Ser. No. 647,853, filed on Jan. 30, 1991 and entitled Paper Feeder Insert Tray by Conrad John Bell.

This invention relates to printing machines, and more particularly, to a flexing paper tray to be used with such a machine.

In the art of xerography or other similar image reproducing arts, a latent electrostatic image is formed on a charge-retentive surface such as a photoconductor which generally comprises a photoconductive insulating material adhered to a conductive backing. This photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images is transferred to plain paper.

It should be understood that for the purpose of the present invention, the latent electrostatic image may be generated from information electronically stored or generated, and the digital information may be converted to alphanumeric images by image generation electronics and optics. However, such image generation electronic and optic devices form no part of the present invention.

Paper feeders are used with automated drive rolls throughout the industry in conjunction with printers or copiers of the type just discussed in order to feed copy sheets at a high rate of speed and thereby increase the throughput of the machines. These feeders are costly, cumbersome and quite complicated when evaluated for use in feeding sheets in low cost, slow speed machines. Also, it has become increasingly common to feed large copy sheets (i.e., 11×17", 12×18", 18×24", 24×36" or 36×48", etc) in some of these low speed machines, however, use of prior sheet feeders for this application has been costly and difficult at best. One of the problems with feeding "C", "D" and "E" size copy sheets is that the automatic sheet feeder tray must be sandwiched between the reproduction portion of the machine and the stand on which the machine is placed and extend beyond a preferable maximum machine front to rear distance of 24". This 24" extension limit of the copy sheet tray is an absolute requirement for copiers, such as, the XEROX 2520® Engineering Copier since the tray must not interfere with the return of original documents around the back of the machine to a catch tray positioned within the stand.

Accordingly, in accordance with one aspect of the present invention, a pivotable paper tray is disclosed which comprises a two-part arrangement. A first part of the two-part arrangement includes a rigid copy sheet holding portion while a second part of the two-part arrangement includes a flexible, movable portion pivotably attached to said rigid copy sheet holding portion and adapted to be pivoted up and away from said rigid copy sheet holding portion during insertion of said paper tray into a machine in order to fan the copy sheets and minimize the footprint of the machine.

Alternatively, and in another aspect of the present invention, in order to provide the fanning feature that brakes the bond between copy sheets and thereby enhance feeding of the copy sheets and also to decrease the footprint of a machine necessary for storage of large copy sheets, a stationary upwardly curved member, such as, a ramp or chute could be used interlacing with and extending below the bottom surface of a non-articulating tray so as to allow the paper to curve up the curved member without stubbing of the copy sheets on the curved member when the non-articulating tray is inserted into the machine, thereby fanning the copy sheets and minimizing multi-feeding of the copy sheets. The curved member could be downwardly sloped, if desired.

The accompanying drawings, which are incorporated in and constitute a part of this specification, illustrate a preferred embodiment of the invention and, together with the description, serve to explain the principles of the invention.

Reference will now be made in detail to the present preferred embodiment of the invention which is illustrated in the accompanying drawings.

Figure 1:
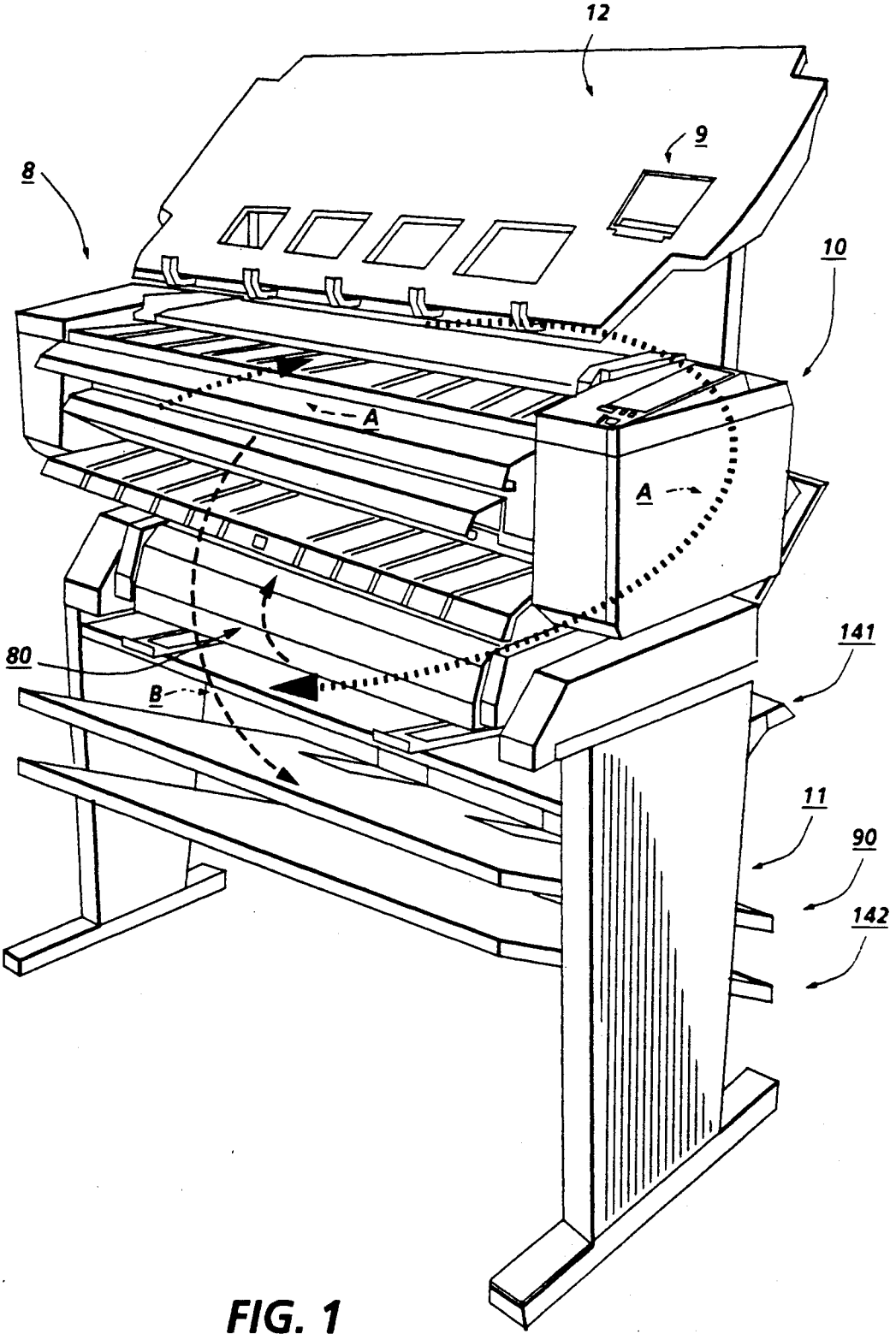
FIG. 1 is a perspective view of an embodiment of the apparatus made in accordance with the present invention for feeding large copy sheet media into a reproduction machine while maintaining a small machine footprint.
Figure 2:
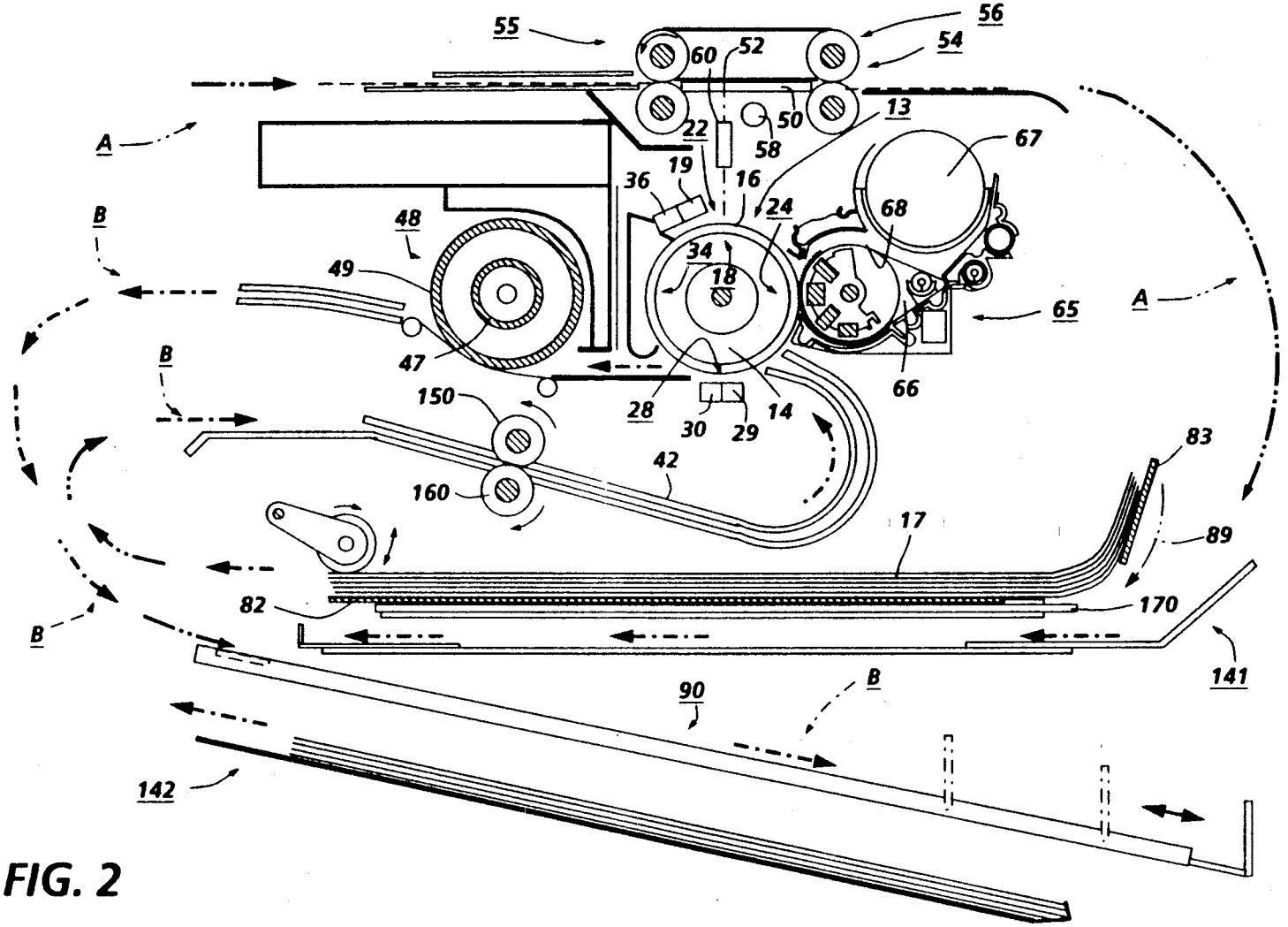
FIG. 2 is a partial schematic side view of the machine of FIG. 1 showing the flexible copy paper tray of the present invention.

Referring to FIGS. 1 and 2 of the drawings there is shown by way of example an automatic xerographic reproduction or printing machine, designated generally by the numeral 8 incorporating the flexible media tray structure of the present invention.

Machine 8 has a suitable frame or housing 10 within which the machine xerographic section 13 is operatively supported. The xerographic section 13 is supported by stand 11. Briefly, and as will be familiar to those skilled in the art, the machine xerographic section 13 includes a recording member, shown here in the form of a rotatable photoreceptor 14. In the exemplary arrangement shown, photoreceptor 14 comprises a drum having a photoconductive surface 16. Other photoreceptor types such as belt, web, etc. may instead be contemplated. Operatively disposed about the periphery of photoreceptor 14 are charge station 18 with charge corotron 19 for placing a uniform charge on the photoconductive surface 16 of photoreceptor 14, exposure station 22 where the previously charged photoconductive surface 16 is exposed to image rays of the document being copied or reproduced, development station 24 where the latent electrostatic image created on photoconductive surface 16 is developed by toner, transfer station 28 with transfer corotrons 29, 30 for transferring the developed image to a suitable copy substrate material such as a copy sheet 17 brought forward in timed relation with the developed image on photoconductive surface 16, and cleaning station 34 that could include a cleaning blade and discharge corotron 36 for removing leftover developer from photoconductive surface 16 and neutralizing residual charges thereon.

Copy sheets 17 are brought forward to transfer station 28 by idler roll 150 and registration/drive roll 160 which is controlled by a conventional controller (not shown), with sheet guides 42, 43 serving to guide the sheet through an approximately 180° turn prior to transfer station 28. Following transfer, the sheet 17 is carried forward to a fusing section 48 where the toner image is fixed by fusing roll 49. Fusing roll 49 is heated by a suitable heater such as lamp 47 disposed within the interior of roll 49. After fixing, the copy sheet 17 is discharged into a catch tray 90.

A transparent platen 50 supports a document as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55, 56, respectively, on each side of scan point 52 for moving a document across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer within canister 67. As will be understood by those skilled in the art, developer comprises a mixture of larger carrier particles and smaller toner or ink particles. A rotatable magnetic brush developer roll 68 is disposed in predetermined operative relation to the photoconductive surface 16 in developer housing 65, roll 68 serving to bring developer from sump 66 into developing relation with photoreceptor 14 to develop the latent electrostatic images formed on the photoconductive surface 16. All of the machine functions are controlled by a conventional controller or microprocessor.

As shown in FIGS. 1–3B, automatic sheet feeder 80 is positioned between xerographic processor housing 10 and support stand 11 and includes a conventionally heated, two-part retractable tray 81 for supporting copy sheets in a stack-like fashion. A first portion 82 of the two-part tray 81 is non-pivotable and is adapted to support copy sheets in a substantially horizontal plane while a second portion 83 of the two-part tray 81 is pivotally connected by suitable conventional means to first portion 82 at pivot 84 and adapted to pivot along arc 89 when a cam follower member 85 attached thereto comes into contact with a cam member 86 which is supported by frame member 87 and thereby support the rear an end portion of copy sheets inserted into tray 81 in a bent or curved fashion when the tray is in its operating position underneath housing 10 as in FIG. 3A. Pivotable tray 81 has advantages over prior copy sheet trays in that it allows machine base 11 to include a document return function without extending the back of the unit as a whole and thereby increasing the footprint of the unit and its pivoting feature fans the copy sheets, thus breaking the edge bond that sheared copy sheets have and as a result, enhances feeding of the copy sheets by minimizing multi-sheet feeding. Additionally, the tray is supported by and positioned in stand 11 for easy access when loading with copy sheets is required.

Alternatively, to provide for minimum printer footprint and the fanning feature that brakes the bond between copy sheets and thereby enhancing feeding, a stationary upwardly curved ramp or chute could be used interlacing with and extending below the bottom surface of a non-articulating tray (not shown) so as to allow the paper to curve up the ramp or chute without stubbing of the copy sheets, thereby fanning the copy sheets and minimizing multi-feeding of the copy sheets. The ramp or chute could be downwardly curved, if desired. Alternatively yet, the copy sheets could be allowed to extend over the bottom surface of a copy sheet holding tray and hang freely down the back of a machine to achieve the same purposes of a smaller printer footprint and fanning of copy sheets to enhance feeding.

Figure 3A:
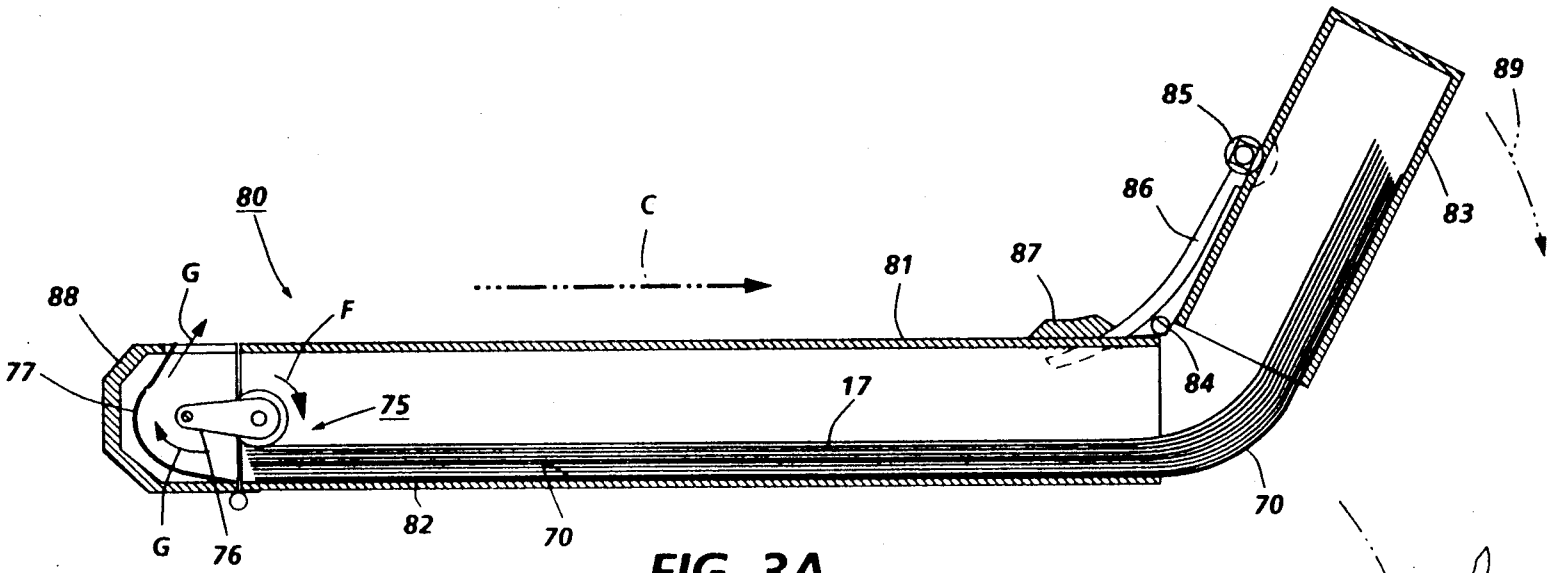
FIGS. 3A and 3B show enlarged schematic side views of the flexible copy paper tray of the present invention employed in the reproduction machine of FIGS. 1 and 2 in an "in use" position in FIG. 3A and a copy sheet loading position in FIG. 3B.
Figure 3B:
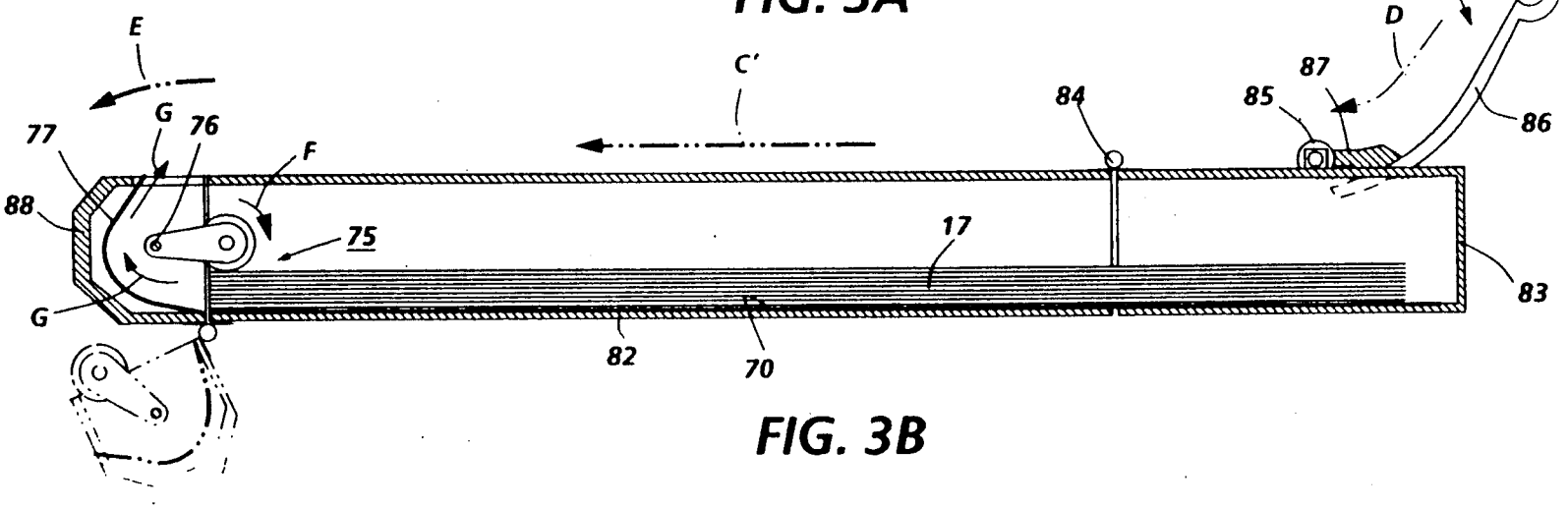

Copy sheet tray 81 is withdrawn from stand 11 when copy sheets have been exhausted and pivotable portion 83 thereof pivots around pivot point 84 from a position shown in FIG. 3A to the position shown in FIG. 3B. The same procedure is followed when different sized copy sheets are to be placed within the tray.

With reference to FIGS. 3A and 3B, copy sheet tray 81 is adapted to slide on rails 170 of FIG. 1 in the direction of arrows C and C'. For copy sheet insertion purposes, tray 81 is pulled to the left as indicated by arrow C' in FIG. 3B to an open position and housing 88 is rotated in the direction of arrow E to the position shown in phantom which removes feeder 75 from interfering with the placement of copy sheets onto membrane 70. Feeder 75 is mounted on shaft 76 that is adapted to rotate the feed head of Feeder 75 by the use of gearing and a motor connecting thereto (not shown). Membrane 70 is adhered to and extends along the bottom of tray portion 82 and also extends into but is not adhered to rotatable portion 83 of the tray. The membrane is made of a flexible material, such as, polyurethane and serves to seal copy sheets 17 from the environment outside tray 81 when the tray is in its "in-use" position shown in FIG. 3A. After copy sheets have been placed into the tray, it is pushed along rails 170 toward the back of machine 8 and into the position of FIG. 3A. This action causes feeder 75 to be positioned on top of copy sheets 17 for rotation in the direction of arrow F to feed copy sheets along baffle 77 in the direction of arrow G into the nip formed between idler roll 150 and registration roll 160. A tray 142 is provided for copy paper storage.

In operation, a document is inserted into machine 8 in the direction of arrow A. The document advances to a point an stops for the feeding of a copy sheet. Automatic activation of the feed rolls will advance the copy sheet about 4–6" out of the tray and into the registration rolls of the machine as shown by arrow B. A microprocessor starts the document and copy sheet in synchronism with each other with the document traveling in the direction of arrow A and the copy sheet traveling in the direction of arrow B as shown in FIG. 1. This process is repeated as necessary for the number of copies required.

It should now be understood that a pivoting paper tray has been disclosed that allows a machine to print onto large copy sheets, e.g., "D" size of 24×36", with the machine having a front to back depth of 24". This minimal footprint is attained through the used of a two-part paper tray which includes a portion thereof that pivots up along the back of the machine.

While the invention has been described with reference to the structure shown, it is not confined to the specific details set forth, but is intended to cover such modifications or changes as may come within the scope of the following claims.

What is claimed is:

1. A pivotable paper feed tray, comprising:

a first portion thereof for supporting a portion of copy sheets in a horizontal plane;

a second portion thereof pivotably attached to said first portion and adapted to support a portion of the copy sheets in a configuration curved away from the horizontal plane; and means attached to said second portion of said paper feed tray downstream from the pivot point of said first and second portions that is adapted to be manipulated into pivoting said second portion of said tray away from said first portion when said paper tray is moved in a first direction into a printing apparatus.

2. The paper feed tray of claim 1, wherein said means attached to said second portion of said paper feed tray that is adapted to be manipulated into pivoting said second portion of said paper tray away from said first portion comprises a cam follower member attached to said second portion of said paper tray.

3. The paper feed tray of claim 1, including means for sealing an opening created between said first and second portions of said paper tray when said second portion of said paper tray is pivoted.

4. The paper tray of claim 3, wherein said paper tray is heated.

5. A paper feed tray for holding a stack of sheets which are to be fed out of the tray and into a machine, characterized in that the tray comprises a first portion adapted to support a first part of the stack in a first plane, and a second portion pivotally joined to the first portion for supporting a second part of the stack, the second portion of the tray being movable between a sheet loading position, in which the second portion of the tray is in substantially the same plane as the first portion, and a sheet feeding position, in which the second portion of the tray is inclined to the plane of the first portion, the second portion of the tray being arranged to move the sheet loading position to the sheet feeding position, and vice versa, as the tray is moved into and out of the machine.

6. In a printing apparatus that is adapted to print page image information onto copy sheets fed from a paper tray, the improvement of the paper tray for enabling the feeding of various sized copy sheets including 36"×48" without increasing the footprint of the printer apparatus, comprising:

means for holding a first portion of the copy sheets in a horizontal plane; and means cooperating with said means for holding a first portion of the copy sheets for holding a second portion of the copy sheets in a curved configuration, such that the curving of said second portion of the copy sheets fans the ends of the copy sheets, thereby breaking the bond between the copy sheets and minimizing multi-feeding; and means attached to said means for holding a second portion of the copy sheets in a curved configuration that is positioned downstream from a pivot point between said means for holding a first portion of the copy sheets in a horizontal plane and said means cooperating with said means for holding a first portion of the copy sheets for holding a second portion of the copy sheets in a curved configuration that is adapted to be manipulated into pivoting said second portion of said tray away from said first portion when said paper tray is moved into the printing apparatus.

7. The apparatus of claim 6, including means for pivoting said second portion of said tray away from said first portion when the paper tray is moved in a predetermined direction.

8. The printing apparatus of claim 6, including means for sealing an opening created between said means for holding a first portion of the copy sheets and said means for holding a second portion of the copy sheets in a curved configuration when said means for holding a second portion of the copy sheets is pivoted.

9. A printing apparatus having a pivotable paper feed tray, comprising:

an opening within a front wall of the printing apparatus for the insertion of the pivotable paper feed tray;

a first portion thereof for supporting a portion of copy sheets in a horizontal plane after insertion of the pivotable paper feed tray into said opening of the printer;

a second portion thereof pivotably attached to said first portion and adapted to support a portion of the copy sheets in a configuration curved upward and away from the horizontal plane; and means for pivoting said second portion of said tray upward and away from said first portion when said paper tray is moved in a first direction in order to fan the copy sheets and minimize the footprint of the printer.

10. A pivotable paper feed tray, comprising:

a first portion thereof for supporting a portion of copy sheets in a horizontal plane;

a second portion thereof pivotably attached to said first portion and adapted to support a portion of the copy sheets in a configuration curved away from the horizontal plane; and follower means connected to said second portion of said paper feed tray, said follower means is adapted to mate with a cam member in a machine into which the paper feed tray is to be inserted in order to pivot said second portion of said tray away from said first portion when said paper tray is moved in a predetermined direction.

* * * * *